United States Patent [19]

Suzuki et al.

[11] Patent Number: 4,954,743

[45] Date of Patent: Sep. 4, 1990

[54] IGNITER PLUG STRUCTURE HAVING SEMICIRCULAR GROOVES

[75] Inventors: Takahiro Suzuki; Yüki Izuoka; Noboru Aoki, all of Nagoya, Japan

[73] Assignee: NGK Spark Plug Co., Ltd., Nagoya, Japan

[21] Appl. No.: 281,259

[22] Filed: Dec. 7, 1988

[30] Foreign Application Priority Data

Dec. 15, 1987 [JP] Japan ..... 62-315133

[51] Int. Cl.[5] ..... H01T 13/32; H01T 13/16

[52] U.S. Cl. ..... 313/120; 313/11.5; 313/139

[58] Field of Search ..... 313/120, 141, 139, 11.5, 313/131 A

[56] References Cited

U.S. PATENT DOCUMENTS

| | | | |
|---|---|---|---|
| 1,707,741 | 4/1929 | Rabezzana | 313/11.5 |
| 2,076,038 | 4/1937 | McKone | 313/11.5 X |
| 2,874,321 | 2/1959 | Summerer | 313/139 X |
| 3,330,985 | 7/1967 | Johnston | 313/120 |
| 3,825,784 | 7/1974 | Lindsay | 313/11.5 |
| 4,771,209 | 9/1988 | Ryan | 313/141 X |

FOREIGN PATENT DOCUMENTS 61-23632 6/1986 Japan .

OTHER PUBLICATIONS

"Development of Low Voltage Shunted Surface GAP Spark and Igniter Plugs for Reciprocating and Gas Turbine Engines", by L. H. Segall, WADC Technical Report, 55-191, Jan. 1955, p. 28.

*Primary Examiner*—Sandra L. O'Shea

*Attorney, Agent, or Firm*—Cooper & Dunham

[57] ABSTRACT

This invention provides an igniter plug, having a plurality of grooves within an outer surface of an annular ground electrode (2), the diameter of which is reduced to about 13 mm. Each groove (6) generally has a semi-circular shape in cross section to allow air flow along the grooves (6), with the number of the grooves (6) in the range from 4 to 16, and the width of each groove is to about 1.0 mm to 2.5 mm. The semi-circular cross section of the grooves (6) makes it possible to provide a large surface for the grooves without increasing the amount of machining, thus, enhancing cooling efficiency when the air flows along the grooves.

3 Claims, 2 Drawing Sheets

IGNITER PLUG STRUCTURE HAVING SEMICIRCULAR GROOVES

BACKGROUND OF THE INVENTION

1. Field of the Invention

This invention relates to an igniter plug structure improved to present diameter-reduced structure particularly in use for a gas or jet turbine engine of aircraft for example.

2. Description of the Prior Art

The igniter plug particularly used for the gas turbine, has been exposed to a jet stream of ignited fuel. The jet stream causes to wear the plug for a relatively short period of time.

In order to avoid the fast wear of the plug, several suggestions have been introduced as seen in U.S. Pat. No. 3,330,985 patented July 11, 1967 and Japanese Pat. No. 23632/61 published June 6, 1986 for example.

In the U.S. Patent, the plug has an outer shell having an annular ground electrode connected to a lower end thereof. A tubular insulator is placed into the shell to have an annular passageway between the insulator and both the shell and the ground electrode.

In addition a center electrode is placed into the insulator to have the annular passageway therebetween.

A air flow is admitted into both the passageways through openings each provided at the shell and the ground electrode. The air flow through the passageways allows to cool the center an ground electrodes so as to prevent the plug itself from being excessively heated.

In the Japanese Patent, the two passageways of U.S. Patent are communicated to eliminate the necessity of one of the passageways.

This being conductive to shortening a longitudinal dimension of the plug.

The references of both the patents however focus the subject on cooling a firing tip of the center electrode and have no suggestion about employing a spark-erosion resistant tungsten metal for the ground electrode.

If the tungsten metal is applied to the igniter of the above patents, it would be difficult to provide an opening with a diameter-reduced ground electrode due to the poor machinability of the tungsten metal.

Further the tungsten metal would be fast oxidized to deteriorate when the gas flow is unable to drop the temperature of the ground electrode below 650 degrees centigrade.

Therefore, it is a primary object of this invention to provide an igniter plug structure which is capable of directly cooling the ground electrode with simple construction, thus enabling to applying the tungsten metal to the ground electrode without let and hindrance, and further readily responding to a diameter-reduced igniter plug particularly in use for a gas turbine engine.

Accordingly, there is provided the igniter plug comprising; the outer annular metallic shell having the annular ground electrode connected to the lower end thereof; the tubular insulator concentrically placed into the metallic shell and having a centerbore therethrough; the center electrode longitudinally positioned within the centerbore and having the firing tip which forms a spark gap region with the lower end of the ground electrode; a plurality of grooves provided with an outer surface of the ground electrode, one open end of each groove being terminated at the lower end of the ground electrode so that the grooves admit the air flow to pass along the grooves to cool the plug including the ground electrode at least.

With the igniter plug mounted on the gas turbine engine, the air flow through a secondary air passage is admitted into grooves to pass therealong so as to enter a combustion chamber. The air flow through the grooves allows to cool the ground electrode as well as the center electrode, thus preventing a temperature of the plug from excessively rising. This makes it possible to apply a spark-corrosion resistant tungsten metal to the ground electrode without let and hindrance. The grooves on the ground electrode readily leads to a tolerable machining so as to present the diameter-reduced igniter plug.

Other objects and advantages of this invention will be apparent from the following description, reference being made to the accompanying drawings wherein preferred embodiments of this invention are shown.

DETAILED DESCRIPTION OF THE INVENTION

Figure 1:
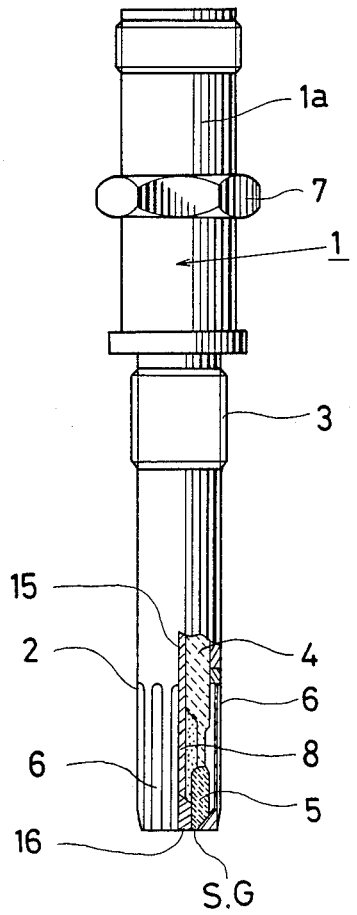
FIG. 1 is a plan view of the igniter plug but partly sectioned.
Figure 2:
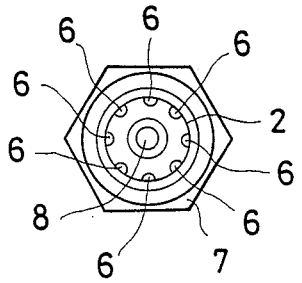
FIG. 2 is a plan view looked from one end of the igniter plug.

In reference to FIGS. 1 and 2 of the drawings, a ceramic annular insulator 4 of an igniter plug 1 has a center electrode 8 in its centerbore 15. The center electrode 8 has a high voltage terminal (not shown) at its upper end.

In the meantime, the insulator 4, to a lower end of which a semi-conducting material 5 is connected, is inserted into an annular metallic shell 1*a* which has an annular ground electrode 2 connected to a lower end of the shell 1*a*.

Figure 3:
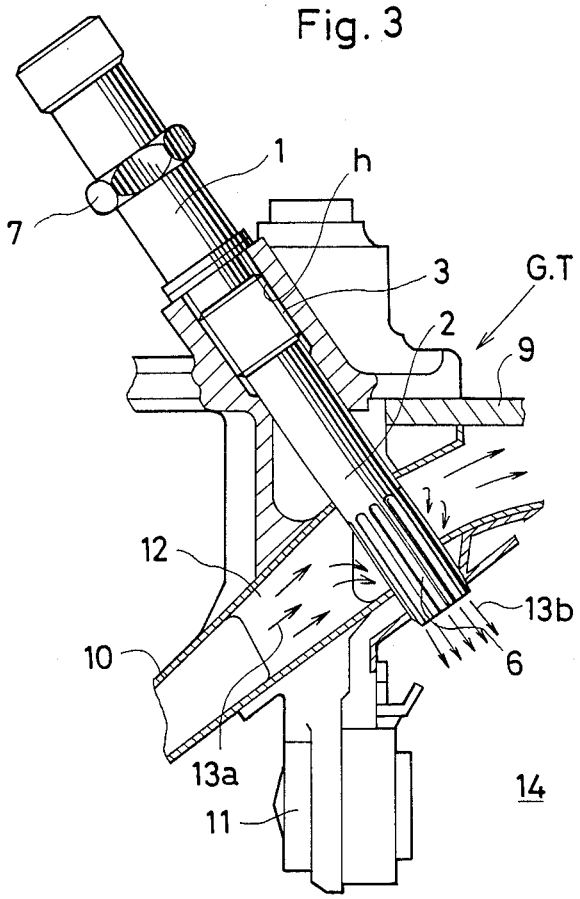
FIG. 3 is a longitudinal sectional view with the igniter plug mounted on the gas turbine engine.

The shell 1*a* has a hexagonal head 7 used when securing the plug 1 to a case 9 of a gas turbine engine (G.T) of FIG. 3 by means of a tool such as, for example, a wrench.

The metallic shell 1*a* further has a threaded portion 3 which is to be screwed to a threaded hole (h) formed at the case 9.

The annular ground electrode 2 is made of a tungsten metal or a tungsten-based alloy, a lower end of which forms a spark gap region (S.G) with a firing tip 16 of the center electrode 8. With an outer surface of the ground electrode 2, is a plurality of straight grooves 6 provided at regular intervals in the circumferential direction. Each of the grooves 6 which is of semi-circular shape in section rises from middle portion of the ground electrode 2, then advancing straight along the longitudinal direction to terminate each open end at the lower end of the ground electrode 2.

In this instance, the ground electrode 2 determines its diametrical dimension to be 13 mm or less than 13 mm. The number of the grooves 6 is preferably 4~16 with each groove 6 as 1.0 mm~2.5 mm in width.

With the igniter plug 1 mounted on the gas turbine engine (G.T) as shown in FIG. 3, the ground electrode 2 projects its lower end as well as the lower open end of each groove 6 into a combustion chamber 14. Substantial part length of each groove 6 is exposed to a air flow passage 12 defined between the combustion chamber 14 and a combustion liner 10.

At the time of operating the gas turbine engine (G.T), a secondary air stream traverses the outer surface of the ground electrode 2 as seen by an arrow 13*a*, and admitted by the grooves 6 to pass therealong as designated by an arrow 13*b* to enter the combustion chamber 14 which is subjected to jet fuel from an injection nozzle 11.

The air flow through the grooves 6 effectively cools entire part of the igniter plug 1 including the ground electrode 2 as well as the center electrode 8.

The ground electrode 2 is effectively cooled by simply forming the grooves 6, it is possible to apply a favorable spark-erosion resistant tungsten metal to the ground electrode 2.

Further, this leads to reducing a diametrical dimension of the ground electrode 2 to suit for the gas turbine engine due to the fact that there is no need to provide an opening with the ground electrode 2.

Figure 4:
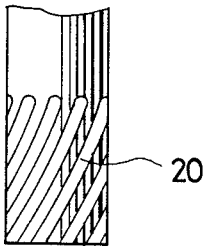
FIG. 4 is a plan view showing a modified form of grooves.

FIG. 4 shows a modified form of this invention in which each groove 20 is in the form of spiral.

It is appreciated that section of groove may be in the form of V-shape or rectangular shape in addition to the semi-circular section.

While the invention has been described in terms of specific examples, it is understood that the scope of the invention is not limited thereby except as defined in the following claims.

What is claimed is:

1. An igniter plug structure which comprises: an outer annular metallic shell (1*a*), having an annular ground electrode (2), connected to a lower end of the metallic shell (1*a*), the ground electrode being made of tungsten or tungsten-based alloy, wherein a diameter of the ground electrode is 13 mm or less than 13 mm;

a center electrode (8) is longitudinally located within the centerbore (15), having a firing end which forms a spark gap region with a lower end of the ground electrode (2); and a plurality of grooves (6) provided within an outer surface of the annular ground electrode (2), wherein each groove (6) continuously extends from an upper end of the ground electrode (2), to terminate at the lower end of the ground electrode (2), each groove having a generally semi-circular shape in cross section to allow air flow along the grooves, the number of the grooves (6) is from 4 to 16, and wherein each groove has constant depth and a width from 1.0 mm to 2.5 mm.

2. An igniter plug structure in accordance with claim 1, wherein the grooves are positioned longitudinally perpendicular to each other in a longitudinal direction of the ground electrode.

3. An igniter plug structure in accordance with claim 1, wherein the grooves are each extended in the form of helical.

* * * * *